US005193518A

United States Patent [19]

Moller et al.

[11] Patent Number: 5,193,518

[45] Date of Patent: Mar. 16, 1993

[54] PORTABLE WIRE SAW

[75] Inventors: Karl H. Moller, Westlake; Andrew L. Jedick, Avon lake; Brian S. Edwards, Lorain, all of Ohio

[73] Assignee: Diamond Products, Inc., Elyria, Ohio

[21] Appl. No.: 792,137

[22] Filed: Nov. 13, 1991

[51] Int. Cl.[5] ..... B28D 1/08

[52] U.S. Cl. ..... 125/21; 125/13.03; 125/16.01; 125/14; 83/811; 83/816; 299/35

[58] Field of Search ..... 125/13.01, 13.02, 13.03, 125/14, 16.01, 16.02, 16.03, 19, 21; 299/35; 83/795, 816–817, 810–813

[56] References Cited

U.S. PATENT DOCUMENTS

| | | | |
|---|---|---|---|
| 433,953 | 8/1890 | Moody et al. . | |
| 884,949 | 4/1908 | Owens | 125/21 |
| 932,591 | 8/1909 | Smith . | |
| 1,106,225 | 8/1914 | Kreeger . | |
| 2,468,336 | 4/1949 | Lewis . | |
| 2,951,475 | 9/1960 | Leo | 125/16.01 |
| 3,663,060 | 5/1972 | Shatwell et al. . | |
| 3,747,981 | 7/1973 | Zuzelo . | |
| 4,175,788 | 11/1979 | Jacobson et al. . | |
| 4,840,431 | 6/1989 | Jedick . | |
| 4,920,946 | 5/1990 | Kuromatsu | 125/16.01 X |

OTHER PUBLICATIONS

Diamond Products Core Cut WS25 promotional brochure, No Date.

Diamond Products CC6500 Series Concrete Saw promotional brochure, No Date.

Diamond Products Drilling Machines—Core Bore M-1 promotional brochure, Oct. 1989.

Diamond Products Diamond Wire promotional brochure, Dec. 1989.

Diamond Products Core Cut WS50 promotional brochure, No Date.

*Primary Examiner*—Bruce M. Kisliuk
*Assistant Examiner*—John A. Marlott
*Attorney, Agent, or Firm*—Renner, Otto, Boisselle & Sklar

[57] ABSTRACT

A portable wire saw for cutting materials such as stone, concrete, asphalt and the like such as highway lane barriers. The portable wire saw includes a frame having a base on which is mounted a power source. Attached to the base is a plurality of wheels for easy portable movement of the wire saw. At least one of the wheels also provides a pivot point for the frame so that the wire saw can be pivoted between a cutting position and a non-cutting position. The power source drives a wire saw blade carried on a triangular support structure consisting of two pulleys and a drive wheel. The drive wheel is operably connected to the power source. The position of the pulleys is capable of being adjusted relative to the drive wheel. In a preferred embodiment the triangular support structure is arranged in a vertical orientation with the upper pulley functioning to keep the return path of the wire saw blade from having to pass through the material being cut.

16 Claims, 2 Drawing Sheets

PORTABLE WIRE SAW

TECHNICAL DISCLOSURE

The invention generally relates to apparatus for cutting and shaping blocks of stone, concrete and the like. More specifically, the invention concerns a portable wire saw that can conveniently be used at construction sites to cut concrete blocks such as those commonly used as safety barriers for highways.

BACKGROUND OF THE INVENTION

Safety barriers that are used to divide or separate highway vehicle lanes are a common sight along the various interstates and other freeways, particularly at construction sites. The barriers are sometimes used as temporary lane designators and typically separate two or more lanes of traffic traveling in opposite directions. Such barriers generally serve as permanent safety barriers in lieu of guard rails and similar structures.

These highway safety barriers are typically made of concrete or similar materials. Each barrier is generally trapezoidal in transverse section, and typically has a height of a few feet and may be six or more feet in length. The barriers also may be a foot or more wide. Of course, the exact size and shape of each barrier may vary depending on the particular use and design.

The safety barriers are commonly laid end to end along a stretch of a road requiring lane separation. Most of the barriers used at a particular site will usually be of a uniform length. However, it is not unusual for the standard barrier length to be unworkable in some situations, such as near the ends of a job site, around curves, or near bridge abutments and similar obstructions. In such cases, it is often desirable to have a barrier with a shorter than standard length. Also, many of the safety barriers utilized today are cast in whole or part as a single continuous or integral length. In order to allow such continuous cast barrier to properly expand and contract as a result of exposure to the elements, it is necessary to cut such barriers at regular intervals. Generally, it is desirable to form a cross-wise cut in the barrier without cutting the barrier all the way through.

A common device used to cut concrete pavement is a flat saw. A flat saw is typically used to form grooves in concrete. Such saws are used to assist in the removal of concrete by first cutting the concrete into sections and then breaking such sections up into smaller pieces. The flat saw usually includes a large circular saw blade driven by a four cylinder gasoline engine. The circular saw blade includes a large number of teeth or cutting bits on the outer perimeter of the wheel to cut the concrete. An example of a large portable flat saw is a Series CC6500 flat saw sold under the trademark CORE CUT by Diamond Products, Inc. of Elyria, Ohio. An example of a small portable flat saw is disclosed in Jedick U.S. Pat. No. 4,840,431 which is owned by Diamond Products, Inc. It is known that at some construction sites, persons have attempted to cut concrete safety barriers with such flat saws.

Efforts to use a flat saw to cut concrete barriers create problems because the flat saw is not designed or intended for cutting elevated surfaces or for cutting through relatively thick sections of concrete. For example, when only a partial cut is to be made, the flat saw leaves a curved groove at the bottom of the cut which may be unacceptable. Also, as the flat saw cuts through a barrier, friction increases substantially between the barrier and sides of the circular saw blade making the saw difficult to control and producing high frictional heat that dramatically wears the circular saw blade. Positioning of the flat saw is also difficult because the initial cutting surface is usually elevated above the normal cutting surface for such a saw. The flat saw may weigh 1300 pounds or more which increases the difficulty of raising the saw sufficiently to cut a barrier.

The prior art also provides other types of saws that could be used for cutting concrete barriers but they present some distinct disadvantages. Specifically, diamond wire saws are commonly employed in stone quarries. Such wire saws comprise separately a hydraulic pump, a main drive wheel powered by a hydraulic motor, and one or more idler wheels. An example of such a wire saw is a wire saw Series WS25 sold under the trademark CORE CUT by Diamond Products, Inc. Such wire saws are generally not suitable for cutting concrete barriers since they comprise multiple separate and distinct pieces and they require significant amounts of time to set up.

The prior art does provide very large wire saws for cutting concrete barriers. An example of such a saw is a wire saw sold by the W. F. Meyers Company, Inc. of 1017 14th Street, Bedford, Ind. This wire saw which weighs about 5,000 pounds is designed to be mounted on the bed of a truck or trailer. Unfortunately, this wire saw is quite large and costly.

Thus, there is a need for a portable and compact apparatus that can be used to cut and shape large concrete barriers at construction sites and other locations as well.

SUMMARY OF THE INVENTION

The present invention contemplates an apparatus that can easily and conveniently be used to cut and shape large concrete blocks and the like such as concrete safety barriers, which apparatus is both compact and easily transportable to and around a construction site. According to this aspect of the invention, a portable wire saw apparatus is provided that utilizes some of the features of a conventional flat saw. In this respect, the portable wire saw includes a compact power source such as a four cycle gasoline engine mounted on a base or frame. The frame also includes a set of wheels so that the apparatus can be easily moved around a construction site. The wire saw apparatus also includes handles to facilitate manual control of the apparatus. By utilizing some of the features of a conventional flat saw, the invention can be realized by modifying equipment usually available to a typical highway construction crew. Alternatively, of course, the invention can be realized by constructing a separate apparatus.

The invention further contemplates a portable wire saw that uses a wire saw blade to cut the concrete blocks. According to this aspect of the invention, the wire saw blade is driven at high speed by the frame-mounted engine about a triangular support structure made up of a set of two or more pulleys and a drive wheel coupled to the engine. The pulleys and drive wheel provide a closed path of travel for the wire saw blade and further define a cutting region between at least two of these support elements.

The wire saw blade is supported by the pulleys and drive wheel in such a manner that the wire saw blade can pass through a concrete block or barrier while engaging or passing through the barrier only one time.

According to this aspect of the invention, one of the pulleys is preferably vertically oriented with respect to the drive wheel and the other pulley to prevent the return pass of the wire saw blade from passing through the concrete barrier. The path of the wire saw blade between the drive wheel and the other pulley may be used as the cutting region.

The invention further contemplates a portable wire saw that can be easily positioned for cutting a large concrete block or barrier. According to this aspect of the invention, the wheels are mounted on the frame so that the frame can be pivoted about an axis that lies generally transverse to an axis that lies along the cutting region of the wire saw blade. Thus, the apparatus can be pivoted in one direction so as to raise the cutting region of the wire saw blade above the top of the concrete block, and as the apparatus is pivoted back down the wire saw blade cuts through the barrier in a controllable manner. The handles of the portable wire saw may be conveniently positioned to facilitate control of the pivoting operation.

The invention also contemplates a portable wire saw apparatus that can be easily adjusted for different sizes and shapes of the barriers to be cut. According to this aspect of the invention, a portable wire saw of the above-described type further includes means to adjust the relative positions of the pulleys and drive wheel to accommodate different barrier configurations.

These and other aspects and advantages of the present invention will be apparent to those skilled in the art from the following detailed description of the preferred embodiment in view of the accompanying drawings.

BRIEF DESCRIPTION OF THE DRAWINGS

FIG. 4 is a simplified partial perspective view of a portion of a wire saw made in accordance with the principles of the present invention illustrating a typical use of the apparatus to cut a concrete barrier or the like.

DETAILED DESCRIPTION OF THE PREFERRED EMBODIMENT

Figure 1:
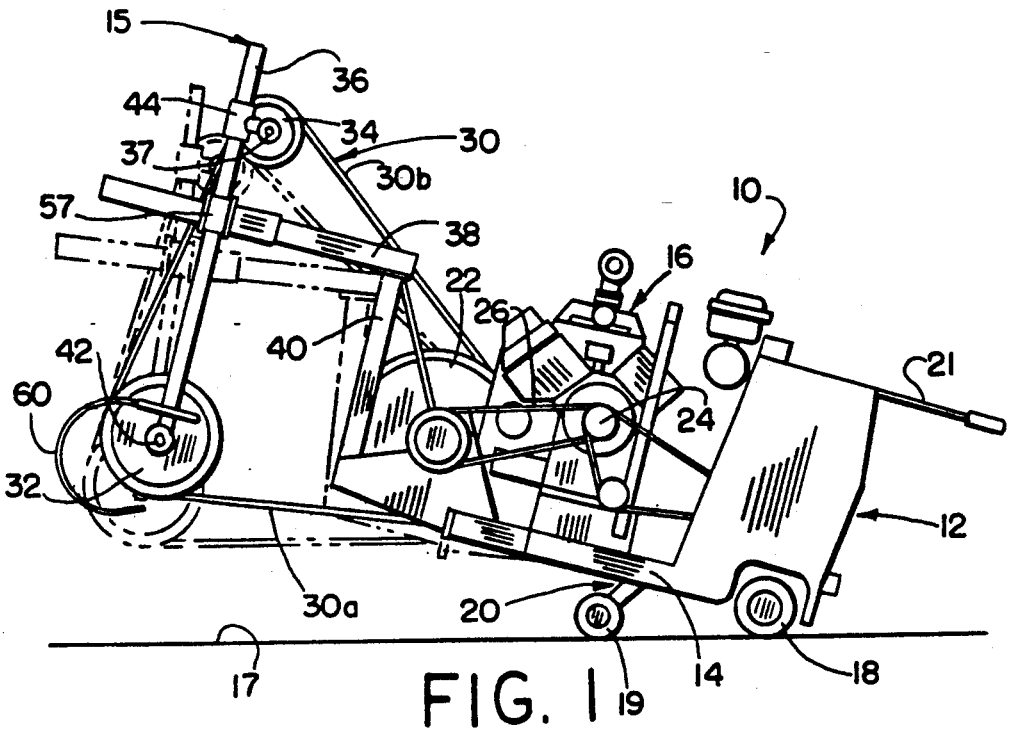
FIG. 1 is a side elevation of a portable wire saw made in accordance with the present invention illustrating the pivotable apparatus in two positions with the lowered position being shown in phantom.

With reference to FIG. 1, there is illustrated a wire saw 10 made in accordance with the principles of the present invention. The wire saw 10 illustrated in the drawings is embodied in a modification of a conventional flat saw such as a Series CC6500 flat saw sold under the trademark CORE CUT by Diamond Products, Inc.

While the invention and preferred embodiment described herein are realized by modification of a conventional flat saw, it should be understood that this is for purposes of explanation and description only, and it should not be construed in a limiting sense as to the scope of the present invention. Those skilled in the art will readily appreciate that the invention can be embodied in an assembly of a new apparatus from custom parts or from commercially available parts such as from another type of flat saw or other equipment.

Modification of a flat saw, however, provides for a quick and easy way to realize the benefits of the instant invention using commercial equipment commonly available at construction sites. Furthermore, while the invention is shown and described as having particular utility in cutting or shaping concrete blocks such as highway barriers, this is again exemplary in nature and should not be construed in a limiting sense. Those skilled in the art will readily appreciate that the instant invention can be used in numerous applications requiring the cutting and shaping of large blocks or pieces of dense material such as concrete and the like.

The wire saw 10 includes a support frame 12 having a base 14 and a cutting portion 15. An engine 16 is mounted on the base 14. The engine 16 may be any conventional power source such as, for example, an electric motor or a gas or diesel engine that has sufficient horsepower to drive a wire saw blade at high speed. The base 14 includes a pair of rear wheels 18, which permit the wire saw 10 to be conveniently moved about a construction site or other area of use. The wire saw 10 also includes a pair of front forward wheels 19 that are positioned near a balance point of the wire saw 10 so that the wire saw 10 can be pivoted in an up/down manner as shown in phantom in FIG. 1 relative to a surface 17 utilizing a conventional raise and lower mechanism which is partially shown at 20. For example, the solid-line view of FIG. 1 may be the noncutting position of the wire saw 10 with the fulcrum point selected so that the wire saw 10 normally rests in such position. One or more handles 21 may be provided attached to the frame 12 to facilitate steering, tilting or pivoting the frame 12 as illustrated in FIG. 1. The wheels 19 define a pivot axis (which extends perpendicular to the plane of the drawing in FIG. 1) about which the wire saw 10 can be tilted for positioning the apparatus to cut a concrete barrier or the like.

Figure 2:
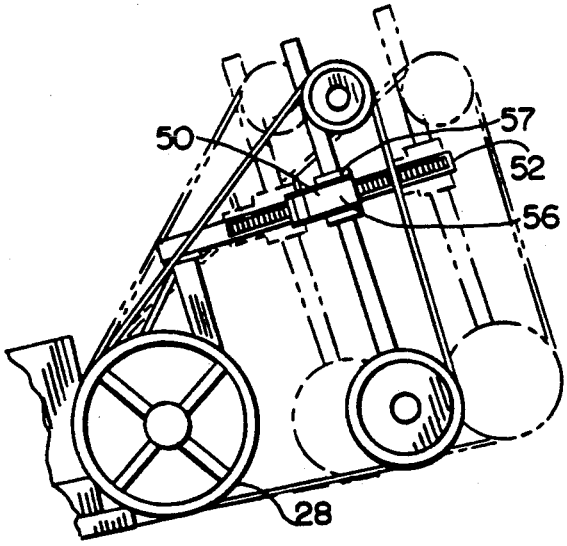
FIG. 2 is a opposite side elevation of a portion of the portable wire saw illustrated in FIG. 1 showing a rack for adjusting positions of the support pulleys with respect to the drive wheel, with some of the positions shown in phantom.

As better shown in FIG. 2, the wire saw 10 further includes a drive wheel 22 coupled to a main drive shaft 24 of engine 16 by a drive belt 26. A conventional clutch mechanism (not shown) may be provided to engage the engine 16 and drive wheel 22 after the engine 16 is activated. The drive wheel 22 includes a circumferential guide groove 28 which receives a wire saw blade 30. The groove 28 helps to prevent the wire saw blade 30 from slipping off the drive wheel during a cutting operation. The wire saw blade 30 may be any suitable flexible wire or band saw and typically will have a length of about eighteen feet. A particular wire saw blade used successfully to realize the present invention is a one-half inch diamond wire saw blade manufactured by Diamond Products, Inc. The wire saw blade 30 is also supported by a lower forward guide pulley 32 and an upper middle guide pulley 34. The pulleys 32 and 34 include grooves similar to the drive wheel 22 and are sufficiently spaced apart so that there is adequate tension on the wire saw blade 30. Therefore, the drive wheel 22 can rotate the wire saw blade 30 at high speed, particularly when the wire saw blade 30 is cutting through a barrier, such as that shown in FIG. 4.

Preferably, the high speed movement of the wire saw blade 30 that travels between the lower pulley 32 and the drive wheel 22 is used as the cutting surface 30*a* of the wire saw blade 30. Those skilled in the art will appreciate, however, that the particular portion of the wire saw blade 30 used as the cutting surface can be modified depending on the requirements of the particular application. With reference to FIG. 1, it will be noted that the cutting surface 30*a* lies on an axis that is generally transverse to the pivot axis of the wheels 19. However, in certain applications it may also be desirable that these two axes not be transverse to each other, but in most applications it is preferred that they be transverse as this permits the user to easily position the wire saw blade 30 for cutting by simply tilting the frame 12. The wire saw blade 30 is capable of forming a straight cut through the concrete barrier, and in particular it does not leave a curved groove as would the circular saw blade of a flat saw in situations where it is desired to not cut all the way through the concrete barrier.

The pulleys 32 and 34 are rotatably mounted on a substantially vertically extending position arm 36. The position arm 36 is adjustably attached to the frame 12 by a substantially horizontally extending extension arm 38 and a substantially vertically extending support arm 40. The lower pulley 32 may be attached with a shaft 42 to one end of the position arm 36. The position of the lower pulley 32 is preferably selected so that when the wire saw 10 is fully tilted to cut through a concrete barrier (as shown in phantom in FIG. 1), the lower pulley 32 and the drive wheel 22 have a generally horizontal to somewhat downward orientation.

Figure 3:
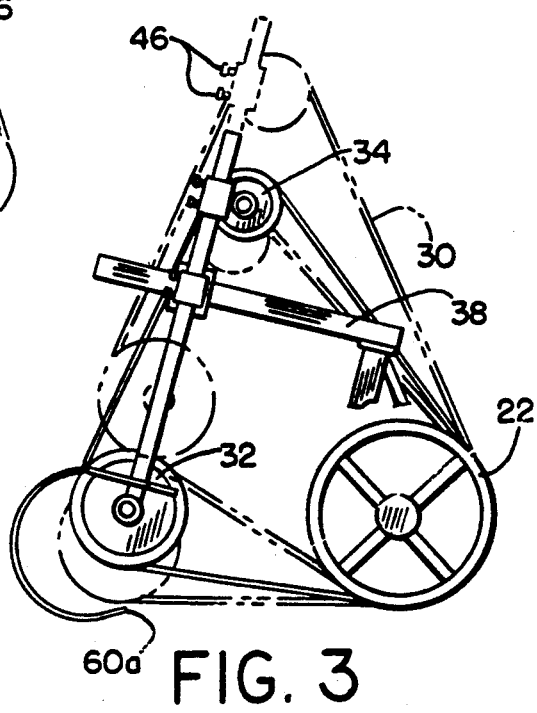
FIG. 3 is a partial side elevation similar to FIG. 1 but illustrating the sleeve assembly for adjusting the vertical position of one or the pulleys with respect to the drive wheel.

The position arm 36 extends above the extension arm 38 to provide a support for the upper pulley 34. The upper pulley 34 may be attached to the position arm 36 by means of a shaft 37 secured to a slide sleeve 44. A pair of bolts 46 extend through the sleeve 44 and can be used to secure the sleeve 44 at a desired position along the position arm 36 (as shown in phantom in FIG. 3).

As illustrated in FIG. 2, the position arm 36 can be selectively positioned closer or farther from the drive wheel 22. This has the effect, of course, of positioning the lower pulley 32 similarly closer or farther from the drive wheel 22. This allows the user to adjust the apparatus for different sized barriers to be cut as well as to fully adjust the tension on the wire saw blade 30. The position arm 36 is preferably adjustably attached to the extension arm 38 by the rack and pinion assembly 50 shown in FIG. 2, or by other adjustable means such as a detent and locking plate. An example of a suitable rack and pinion system that may be adapted for use with the present invention is a rack and pinion system employed in a drilling machine sold under the trade designation M-1 by Diamond Products, Inc. Of course, it will be appreciated that the particular means used to adjustably attach the pulleys 32 and 34 to the frame 12 are largely a matter of design choice provided that they can securely hold the pulleys in place during operation of the wire saw 10.

Rack and pinion assembly 50 comprises a rack 52 mounted upon extension arm 38 and a pinion which is supported for rotation within collar 56 which is attached to position arm 36 by sleeve 57. Sleeve 57 allows the position of the position arm 36 to be adjusted up or down relative to the extension arm 38. As position arm 36 is moved forward or outward by rack and pinion assembly 50 the lower wheel 32 moves forward or outward. Since the wire saw blade 30 length is maintained constant the position of the upper pulley 34 must be lowered as the position arm 36 is moved outwardly and raised as the position arm 36 is moved inwardly.

Substantial frictional heat may be generated as the wire saw blade 30 cuts through a concrete barrier. Therefore, water cooling is provided via a copper tube 60 preferably mounted near the lower pulley 32. The copper tube 60 has a distal end 60*a* (see FIG. 3) directed towards the cutting surface 30*a* so that cooling fluid is sprayed or directed towards the point of frictional contact. The copper tube 60 is connected to a source of fluid such as water under pressure (not shown).

The pulleys 32 and 34 and the drive wheel 22 can be thought of as a triangular support structure for the wire saw blade 30 in which these three support elements lie in a common plane. An important advantage of the instant invention is that the upper pulley 34 can be used to keep the return path of the wire saw blade 30*b* from contacting the concrete barrier a second time. This prevents a double cut thereby inter alia reducing overall frictional forces and heat, as well as reducing the risk of an unwanted cut and unnecessary blade wear. This arrangement also makes the wire saw 10 more compact and easier to manually control with the handles 21.

While the preferred embodiment is illustrated with the triangular support structure oriented vertically, it will be appreciated that the arrangement could also be used horizontally or at other angular orientations. Actual use of the wire saw blade 30 at angles other than vertical will be dependent primarily on the flexibility and convenience available to drive the wheel 22 with the engine 16. Preferably, no matter what arrangement is employed, the portions of the wire saw blade 30 which are not being used to cut an object should be covered with protective guards.

Figure 4:
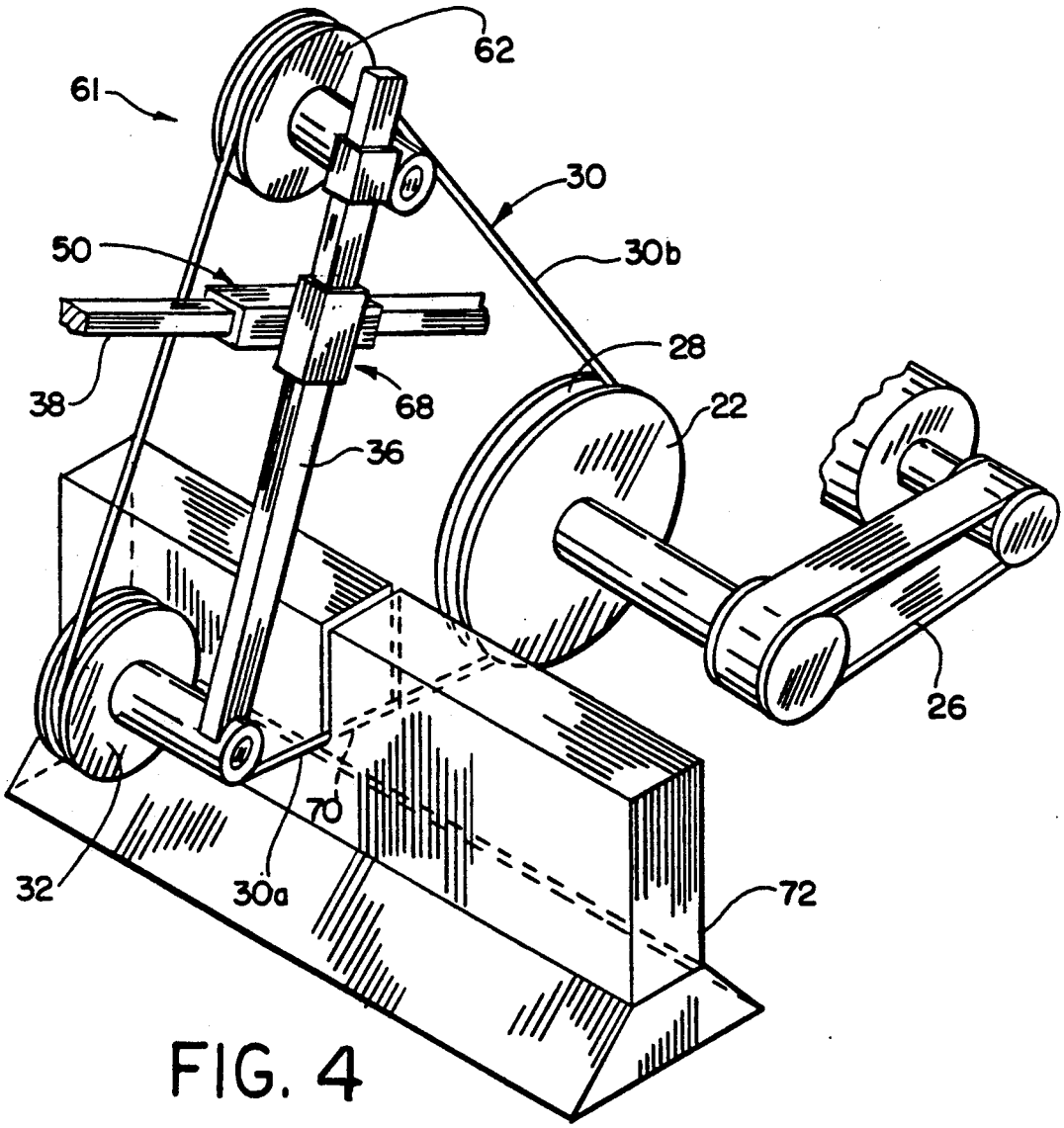

Referring now to FIG. 4 there is illustrated an alternative cutting portion 61 made in accordance with the principles of the present invention. Cutting portion 61 is substantially similar to the cutting portion 15 shown in FIGS. 1–3 thus the same reference numerals have been utilized to identify like elements. Cutting portion 61 differs from cutting portion 15 in that the upper pulley 62 is the same size as lower pulley 32. Thus, in cutting portion 61 pulleys 32 and 62 are both about 16 inches in diameter and drive wheel 22 is about 26 inches in diameter. Cutting portion 61 also differs from cutting portion 15 in that in addition to a rack and pinion assembly 50 (schematically shown) for adjusting the horizontal position of extension arm 38 a rack and pinion assembly 68 (schematically shown) is employed for adjusting the vertical position of extension arm 38.

As seen in FIG. 4 wire saw blade 30 is capable of making a straight and level cut 70 through a concrete barrier 72 with the return portion 30*b* of the wire saw blade 30 not having to travel through the barrier 72.

While the invention has been shown and described with respect to specific embodiments thereof, this is for the purpose of illustration rather than limitation, and other variations and modifications of the specific embodiments herein shown and described will be apparent to those skilled in the art within the intended spirit and scope of the invention as set forth in the appended claims.

We claim:

1. A portable wire saw apparatus for cutting materials such as stone, concrete and asphalt comprising:

a base;

a power source mounted on said base;

a height adjustment mechanism for pivoting said base about a first axis between a first position to a second position;

a drive wheel connected to said power source and rotated by said power source;

a first pulley supported by said base and spaced from said drive wheel along a second axis;

a second pulley supported by said base and located in a common plane with said first pulley and said drive wheel; and a wire saw blade carried by said first and second pulleys and said drive wheel such that said wire saw blade presents a straight cutting surface between said drive wheel and said first pulley.

2. An apparatus according to claim 1, wherein said second axis is generally transverse said first axis and said first and second pulleys and said drive wheel form a triangular support structure for said wire saw blade.

3. An apparatus according to claim 1 wherein said second pulley is vertically oriented with respect to said first pulley and said drive wheel and permits a single cut of a material by said wire saw blade.

4. An apparatus according to claim 3 wherein said first pivot position can be used as a non-cutting position with said wire saw blade cutting through such material as said base is pivoted towards said second position.

5. An apparatus according to claim 4 further comprising liquid cooling means positioned near a region where said wire saw cuts such material to direct cooling fluid towards said region.

6. An apparatus according to claim 5 wherein said cooling means is mounted near said first pulley.

7. An apparatus according to claim 1 further comprising first pulley adjustment means for adjusting the position of said first pulley with respect to said drive wheel.

8. An apparatus according to claim 7 further comprising second pulley adjustment means for adjusting the position of said second pulley with respect to said drive wheel.

9. An apparatus according to claim 8 wherein said first pulley adjustment means includes a substantially vertically extending bar transversely oriented relative to a substantially horizontally extending bar, said bars being adjustable connected to each other so that said first pulley can be positioned closer or further from said drive wheel, and said first pulley and said second pulley adjustment means being mounted on said vertically extending bar.

10. An apparatus according to claim 9 wherein said second pulley adjustment means adjustably and slidably connects said second pulley to said vertically extending bar opposite said first pulley.

11. An apparatus for cutting materials, such as concrete blocks comprising: a motor mounted on a frame with said frame being pivotable about an axis between a cutting position and non-cutting position; a wire saw blade; and a triangular drive means connected to said motor and said frame for rotating said wire saw blade; said drive means having a first guide means, a driven guide means and said a third guide means with each of said guide means in supporting contact with said wire saw blade; said driven guide means being rotatably driven by said motor and said first guide means being spaced from said driven guide means to provide a cutting region such that as said wire saw blade passes between said driven guide means and said first guide means said wire saw blade can cut a material when said frame is pivoted about said axis.

12. An apparatus according to claim 11 wherein said third guide means is vertically oriented with respect to said first guide means and said driven guide means with all said guide means lying in a common plane that is transverse said frame pivot axis.

13. An apparatus according to claim 12 wherein said triangular drive means includes means for adjusting the positions of at least two guide means with respect to the other of said guide means.

14. An apparatus according to claim 13 further comprising handle means to facilitate pivotal movement of said frame.

15. An apparatus according to claim 13 wherein said third guide means controls a return path of said wire saw blade from said first guide means to said driven guide means so that said wire saw blade makes a single cut into the material.

16. An apparatus as set forth in claim 13 wherein said means for adjusting comprises a pair of rack and pinion assemblies.

* * * * *